US009850665B2

(12) United States Patent
Amos et al.

(10) Patent No.: US 9,850,665 B2
(45) Date of Patent: Dec. 26, 2017

(54) LOCKING SYSTEM FOR A STAIR ASSISTANCE DEVICE

(75) Inventors: Ruth Amos, Sheffield (GB); Reginald Copeland, Sheffield (GB)

(73) Assignee: STAIRSTEADY LIMITED, Killamarsh, Sheffield (GB)

( * ) Notice: Subject to any disclaimer, the term of this patent is extended or adjusted under 35 U.S.C. 154(b) by 0 days.

(21) Appl. No.: 14/112,417

(22) PCT Filed: Jun. 19, 2012

(86) PCT No.: PCT/GB2012/051414

§ 371 (c)(1),
(2), (4) Date: Dec. 18, 2013

(87) PCT Pub. No.: WO2012/143741

PCT Pub. Date: Oct. 26, 2012

(65) Prior Publication Data

US 2014/0231738 A1 Aug. 21, 2014

(30) Foreign Application Priority Data

Apr. 19, 2011 (EP) ..... 11003261

(51) Int. Cl.
*E04F 11/18* (2006.01)
*A61H 3/00* (2006.01)

(52) U.S. Cl.
CPC ..... *E04F 11/1863* (2013.01); *A61H 3/00* (2013.01); *A61H 2003/001* (2013.01); *E04F 2011/1868* (2013.01)

(58) Field of Classification Search
CPC ..... A61H 3/00; A61H 2003/001; E04F 11/00; E04F 11/18; E04F 11/1802; E04F 11/1863; E04F 11/1836; E04F 2011/1868
See application file for complete search history.

(56) References Cited

U.S. PATENT DOCUMENTS 3,749,430 A * 7/1973 Jenkins ..... B66C 23/80 403/109.3
4,130,177 A 12/1978 Pandolph
4,269,043 A * 5/1981 Kizu et al. ..... F16D 3/76 464/83
5,022,197 A 6/1991 Aragona
(Continued)

FOREIGN PATENT DOCUMENTS

CA 2151984 12/1996
DE 202006015804 U1 1/2007
(Continued)

OTHER PUBLICATIONS

Gert Severens, International Search Report in PCT/GB2012/051414, dated Dec. 17, 2012, 4 pages, European Patent Office, Rijswijk, Netherlands.

*Primary Examiner* — Michael P Ferguson
(74) *Attorney, Agent, or Firm* — Florek & Endres PLLC

(57) ABSTRACT

A stair assistance device for use with a handrail, the device comprising a sleeve engageable with and slideable relative to the handrail, and a brake element to hinder or prevent sliding movement of the sleeve, wherein, when the sleeve is engaged with a handrail, the brake element is resiliently biased towards the handrail, to hinder or prevent movement of the sleeve when the device is not in use.

9 Claims, 6 Drawing Sheets

(56) References Cited

U.S. PATENT DOCUMENTS

| | | | | |
|---|---|---|---|---|
| 6,209,854 | B1 * | 4/2001 | Sedlack et al. | E04F 11/1863 256/59 |
| 2007/0017170 | A1 | 1/2007 | Manson et al. | |
| 2008/0209853 | A1 * | 9/2008 | Hull | E04F 11/1863 52/832 |

FOREIGN PATENT DOCUMENTS

| | | | | |
|---|---|---|---|---|
| EP | 1621781 | A1 | 2/2006 | |
| GB | 2106790 | A | 4/1983 | |
| GB | 2257723 | | 1/1993 | |
| GB | 2440387 | | 1/2008 | |
| JP | 7-317266 | * | 12/1995 | E04F 11/18 |
| JP | 8-24353 | * | 1/1996 | E04F 11/18 |

* cited by examiner

LOCKING SYSTEM FOR A STAIR ASSISTANCE DEVICE

This application is a U.S. National Stage filing under 35 U.S.C. §371 of International Application No. PCT/GB2012/051414, filed Jun. 19, 2012, which in turn claims priority to European Patent Application No. 11003261.2, filed Apr. 19, 2011.

DESCRIPTION OF INVENTION

The invention relates to a stair assistance device, of the type which may provide assistance when ascending or descending stairs. An example of an earlier such device is shown in UK patent application GB2440387A.

It is common for those with limited mobility to require assistance to use a normal staircase. The elderly, infirm, and those with medical conditions such as sports injuries, are likely to require assistance in this respect. For this reason, it is common to provide lifts in public buildings. However, there are many buildings where the installation of a lift is not a practical (or economical) solution, such as older buildings designed without lift installation in mind, or smaller residential buildings.

Sometimes, a so-called "stairlift" is installed, which commonly comprises a seat mounted on a motorised carriage. The user sits on the seat, and uses a control to instruct the carriage to ascend or descend the staircase. The carriage moves under power of the motor until its upper or lower end point, to transport the user up or down the stairs. There are several disadvantages to such an arrangement. It is common for the tracks to be provided at one side of the staircase over the stairs themselves, which limits the available space to those not using the stairlift, even when the stairlift is not in operation. Stairlifts can also be expensive to buy and install, and this makes them less attractive to elderly people on a limited budget, and to people with only a temporary condition limiting their mobility, such as a sports injury. In addition, undertaking some assisted exercise (such as climbing stairs) can be advantageous for those with mobility issues, so devices such as stairlifts which do not require any physical exertion are undesirable.

The device of GB2440387A comprises two main items—a handrail and a handle. The (conventional) handrail is secured to a wall by means of supports, and the handrail may be made of a substantially hollow elongate section, such as box section. Both ends of the handrail have a round section to allow the handle to fold away to prevent obstruction of the stairs. The handle protrudes at 90 degrees from the handrail, so that in use, it extends transversely of the staircase and is substantially horizontal. The handle includes, at one end, a sleeve that partially encloses the handrail. This sleeve houses a mechanism comprising two materials with different coefficients of friction, which is securely (and irremovably) bonded to the internal surface of the sleeve. The user can apply pressure to the handle to allow the device to move freely when pushed upwards relative to the staircase, but such movement is frictionally hindered or prevented when a downwards force is exerted on the handrail.

This allows the user to move freely up the staircase, but provides the necessary support when it is required, such as when the user falls backwards when ascending the stairs.

SUMMARY OF THE INVENTION

According to a first aspect of the invention, we provide a stair assistance device for use with a handrail, the device comprising a sleeve engageable with and slideable relative to the handrail, and a brake element to hinder or prevent sliding movement of the sleeve, wherein, when the sleeve is engaged with a handrail, the brake element is resiliently biased towards the handrail, to hinder or prevent movement of the sleeve when the device is not in use.

The brake element may be a pad having a contact surface with a relatively high coefficient of friction.

The pad may also have a contact surface with a relatively low coefficient of friction.

The pad may be releasably engageable with the sleeve.

The brake element may be biased by biasing means which may act upon that part of the pad which has a contact surface with a relatively low coefficient of friction.

The biasing means may be part of, or integral with, the pad.

The biasing means may be a leaf spring.

The free end of the leaf may be adjacent the edge of the pad.

The pad may be releasably held within the sleeve.

The pad may be releaseably held by adhesion.

A further brake element may be provided which is engageable with a different side of the handrail.

The further brake element may be engageable with the opposite side of the handrail to the first said braking element.

According to a second aspect of the invention, we provide a stair assistance kit for use with a handrail, the kit comprising a sleeve engageable with and slideable relative to the handrail, and a plurality of interchangeable brake elements to hinder or prevent sliding movement of the sleeve, wherein, when the sleeve is engaged with a handrail, a brake element is resiliently biased towards the handrail, to hinder or prevent movement of the sleeve when the device is not in use; the brake elements comprising pads or inserts which are releasably engageable with the sleeve.

According to a third aspect of the invention, we provide a locking mechanism for a stair assistance device which comprises a plurality of pad assemblies disposed within the physical constraints of the sleeve of a handle bar that substantially encloses a handrail which is slideably movable along the handrail, said pad assemblies providing one or more linear springs that produce a force that applies a friction brake against the said handrail and providing a positive force against which the user can provide an overcoming force when manually moving the handle bar up or down the handrail.

The pad assemblies of the third aspect may comprise a backing plate the first planar contact surface bonded with a material with a high coefficient of friction while the second planar contact surface bonded with a material with a low coefficient of friction, said pad assembly being disposed within the gap between the internal lateral surface of the said handle bar sleeve and the lateral outer surface of the handrail.

One or more of the pad assemblies of the third aspect may comprise a sprung steel backing plate from which a protrusion is formed providing a spring strip in the centre of the first planar surface, said protruding spring strip having its planar surface bonded with a material with a low coefficient of friction while the second planar surface of the sprung steel backing plate is bonded with a material with a high coefficient of friction, said pad assemblies spring provides a force that applies pressure so that the material with a high coefficient of friction of one or more of the associated pad assemblies are held in contact with the outer surface of the hand rail thus the handle bar is frictionally held to the handrail.

It will be appreciated that the brake element could of course be made of any suitable material, and may be of any suitable configuration. For example, a material which has different frictional properties in different directions, or a ratchet arrangement, could be used to allow the stair assistance device to be easily moveable only in selected directions. A magnetic (or electromagnetic) arrangement could also be used to either allow, or hinder or prevent, movement of the stair assistance device on the handrail, as required. This could be achieved by altering the distance the magnet moves from the magnetic material, or by allowing an electromagnet to selectively attract or repel a magnetic handrail material. The electromagnet may be passive when not in use, and be held in place by a corresponding magnet on the opposing side. When activated, the electromagnet may repel the corresponding magnet, such that the electromagnet would only require power when in use. This could be provided by a battery, and the stair assistance device could include a charging mechanism for the battery. Alternatively, the stair assistance device may use a cam, overcentre arrangement, or a hydraulically-actuated arrangement to alter the clamping force applied to hinder or prevent movement of the device relative to the handrail, as required.

It will be appreciated by those skilled in the art that more than one stair assistance device may be provided on the same handrail.

DETAILED DESCRIPTION OF PREFERRED EMBODIMENTS, AND BEST MODE OF THE INVENTION

A specific and non-limiting embodiment of the invention will now be described, strictly by way of example only, with reference to the drawings, of which:

Figure 1:
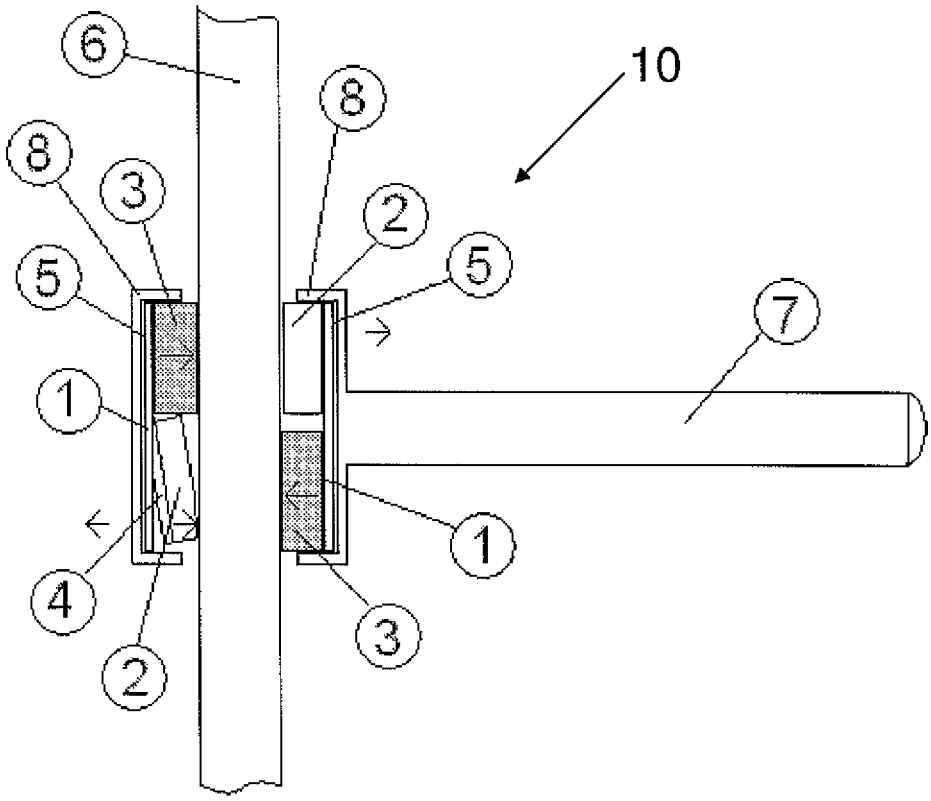
FIG. 1 shows a cutaway view of an embodiment of the device from above.

Referring to FIG. 1, there is shown a stair assistance device, indicated generally at 10. A handle, in the form of handle bar 7 is connected to a sleeve formation 8, and the sleeve formation 8 is engaged (in use) with a handrail 6. Disposed inside the sleeve formation 8, there are pads comprising a pad backing 1, a material with a relatively low coefficient of friction 2 (referred to herein as "low friction material 2"), a material with a relatively high coefficient of friction 3 (referred to herein as "high friction material 3"), a biasing means such as a spring protrusion 4, and an attachment means 5. Each part of the pad may be made of any suitable material—for example, the pad backing may be made of spring steel, the spring protrusion 4 may also be made of spring steel, and may be integral with the pad backing, and the attachment means 5 may be any suitable method of attachment, such as an adhesive with relatively low adhesion properties. This adhesive may be an adhesive applied to the pad backing or the inside of the sleeve, or may be an adhesive carried by a substrate, such as a double-sided adhesive tape.

Alternatively, the pad may be retained in the sleeve by the reactive force of the spring 4, which results from the force transmitted through low friction material 2 when it is in contact with the handrail. Any other suitable retention method may be used; for example, there may be corresponding formations on the pad and the sleeve allowing them to engage with one another, or the pads may be retained by magnets or known fixing methods such as bolts, screws, or clips. In this (preferred) embodiment, the pads are releasably engaged with the sleeve, allowing them to be easily removed or replaced, which is beneficial for cleaning and maintenance purposes.

Figure 2:
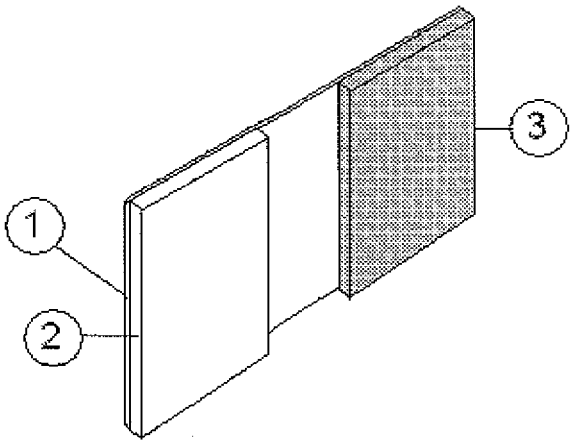
FIG. 2 shows a pad which may be used in a stair assistance device.

FIG. 2 shows one embodiment of a pad assembly, referred to herein as "Pad Assembly A". The backing pad is substantially planar, and has a low friction portion 2, and a high friction portion 3, which are disposed at opposite ends, in the example shown. It will be appreciated that the backing 1, the low friction portion 2 and the high friction portion 3 could be any suitable shape to ensure effective engagement with the handrail 6. For example, the low friction portion 2 and the high friction portion 3 may have a curved surface to engage a handrail with a curved face. The pad assembly may also be provided with any suitable biasing means. The low friction portion 2 and the high friction portion 3 may be attached to the backing 1 by any suitable method, such as bonding, welding, etc.

In this example, the pad assembly comprises a spring steel backing plate 1 onto which are bonded, at opposite ends, two blocks of material with differing coefficient of friction (2 & 3).

Figure 3:
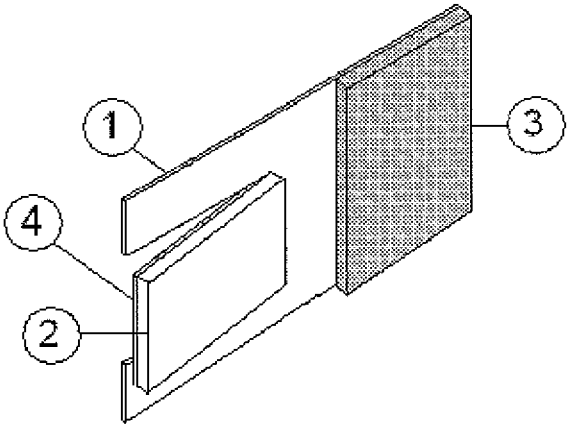
FIG. 3 shows another pad which may be used in a stair assistance device.

FIG. 3 shows another embodiment of a pad assembly, referred to herein as "Pad Assembly B". The pad includes a protrusion 4, which may be made from any suitable material, such as spring steel, and may be integrally formed with the backing plate. In the example illustrated, the low friction portion 2 is mounted on the protrusion 4. The protrusion itself may function as a leaf spring, or an alternative (separate) spring may be provided. In use, the spring takes up the "free play" between the handrail 6 and the handle bar 7. Controlling the "free play" in this way has been found to provide a superior user experience. It can allow better tactile feedback to the user, and can also be used to retain ("park") the stair assistance device at the position at which it has been left by the user. To prevent damage to the handrail, the sprung protrusion has a material with a low coefficient of friction (2) bonded to it, while the opposing end of the pad has a material with a high coefficient of friction (3), to act as a brake.

This embodiment of the invention comprises two separate, dissimilar, replaceable pad assemblies 'A' and 'B', removably attached to the inner surfaces of the sleeve formation 8, by attachment means 5, such as double side adhesive tape, so as to allow maintenance.

Figure 4:
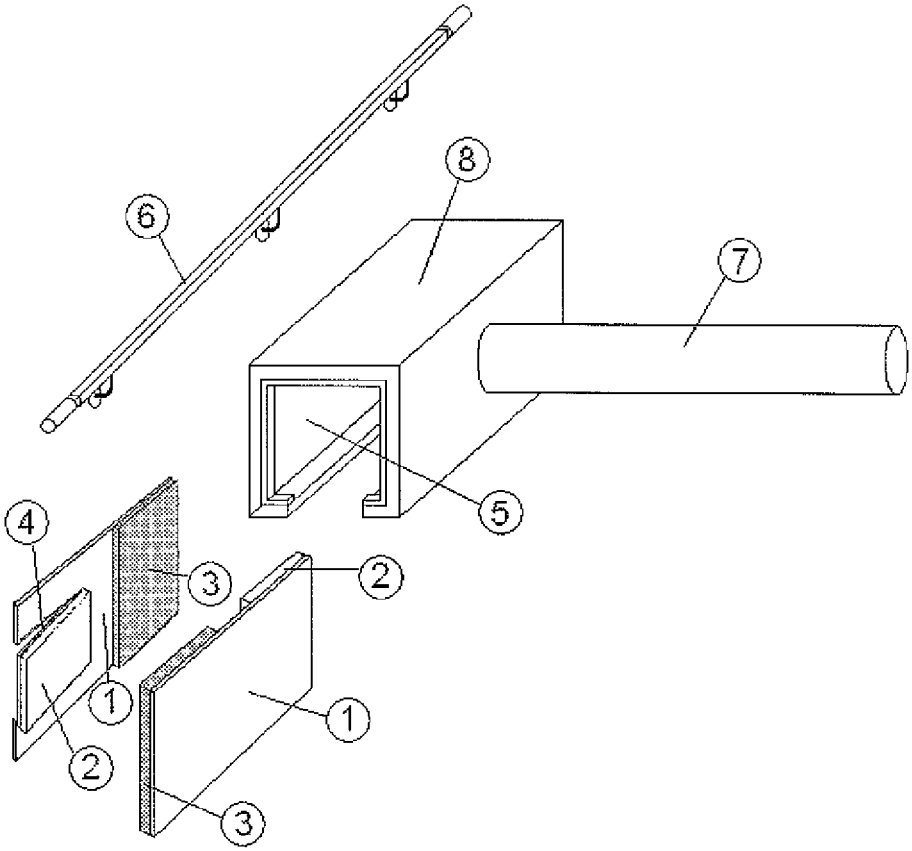
FIG. 4 shows a stair assistance device in exploded form.

As shown in the embodiment of FIG. 4, the end of pad assembly 'A' with the high coefficient of friction is desirably placed opposite the spring end of pad assembly 'B'. This modification provides a number of benefits.

1. Moving the friction materials onto separate backing plates and attaching them to the sleeve with a low adhesive bond (such as double sided tape) allows relatively easy replacement if the braking mechanism shows signs of wear, or if it becomes damaged.

2. The spring built into pad assembly 'B' ensures that the braking surfaces of both pads are held in contact with the handrail when the handle bar is at rest, thus keeping the handle bar locked when not being directly manipulated.
3. The inclusion of the spring in pad assembly 'B' also provides an improved 'feel' to the handle when in operation.
4. The reactive force of the spring acts to retain the pad within the sleeve.

Figure 5:
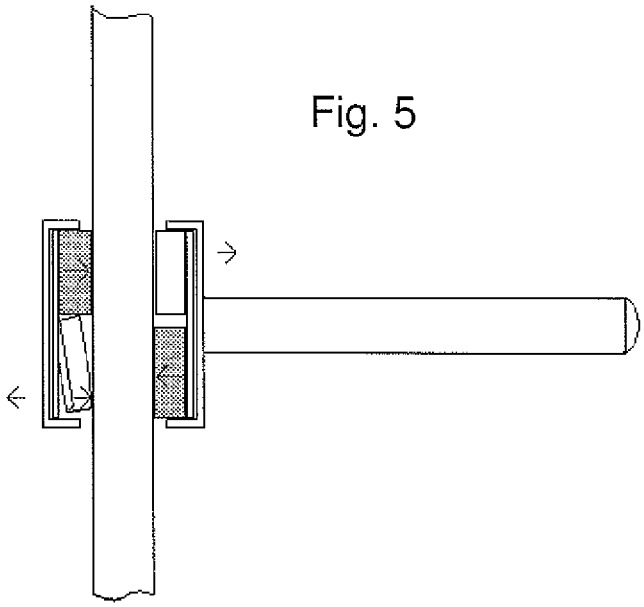
FIG. 5 shows the forces acting on the stair assistance device when not in use.

FIG. 5 shows the forces acting on the device at rest (i.e. when not in use). The leaf spring protrusion 4 presses the material with a low coefficient of friction against the handrail, producing an opposing force that causes a slight (clockwise) rotational force, which holds the material with the high coefficient of friction against the handrail on both lateral surfaces, thus effectively locking the handle bar to the handrail by friction. This retains the stair assistance device in the position in which it has been left by the user.

Figure 6:
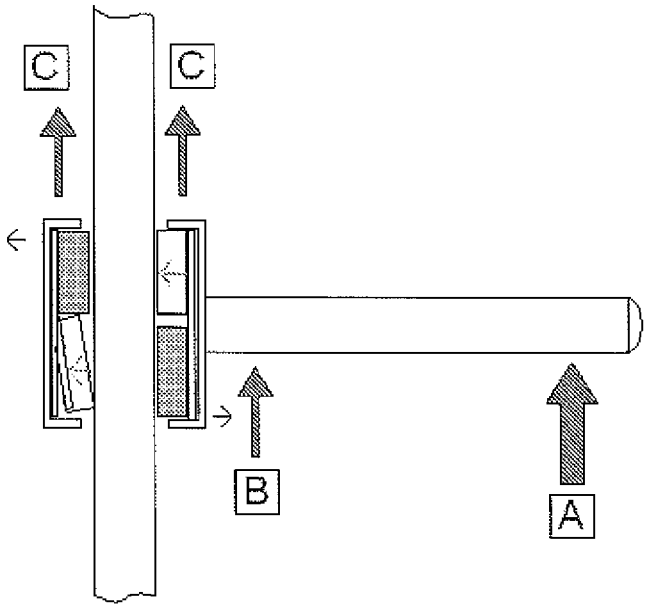
FIG. 6 shows the forces acting on the device when the device is moved upwards, along a handrail.

FIG. 6 shows the forces acting when moving the handle bar up the handrail. To move the handle bar up the handrail in preparation to ascend, a greater force 'A' is applied to the end of the handle bar furthest from the handrail, while a lesser force 'B' is applied nearer the sleeve. The slight (counter clockwise) rotational movement overcomes the action of the sprung steel protrusion until the material with the high coefficient of friction ceases contact with (or is sufficiently 'released' from) the handrail, allowing the handle bar to slide up the handrail in 'C'.

Figure 7:
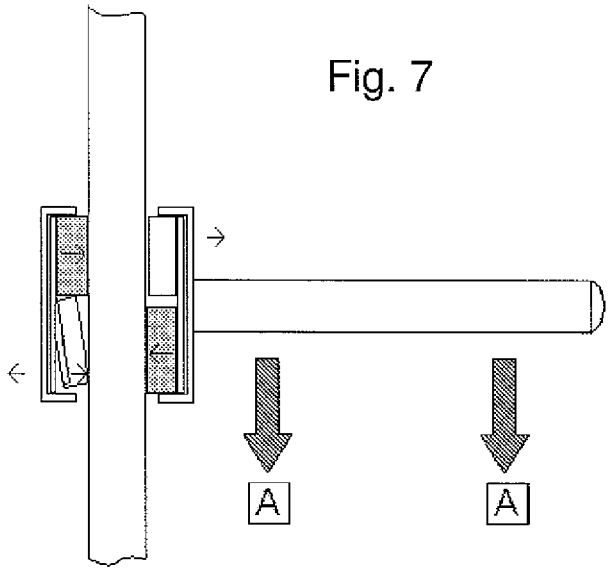
FIG. 7 shows the forces acting on the device when ascending the stairs.

FIG. 7 shows the forces acting when ascending stairs. The user can then pull himself/herself up onto the next stair by pulling against the handle bar, producing an equal force 'A' across the handle bar. This action increases the force pressing the materials with a high coefficient of friction against the lateral sides of the handrail, providing support for the user until they are secure on the stair, at which point the handle bar can be moved up the handrail once again until the user has climbed the full length of the staircase.

Figure 8:
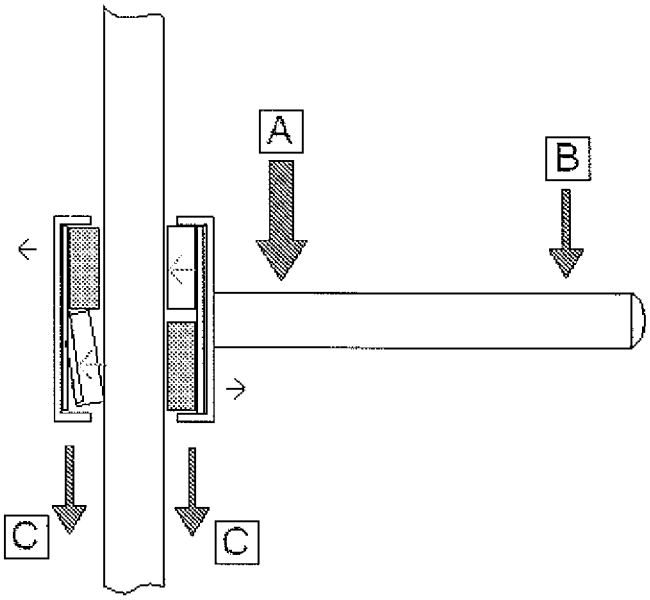
FIG. 8 shows the forces acting on the device when the device is moved downwards, along a handrail.

FIG. 8 shows the forces acting when moving the handle bar down the handrail. When descending the stairs the handle bar is pushed down the handrail by applying a greater force 'A' at the sleeve end of the handle bar than the force 'B' applied at the other (distal) end. This overcomes the action of the sprung steel protrusion, substantially disengages the material with the high coefficient of friction from the handrail and allows the handle bar to move down the rail.

Figure 9:
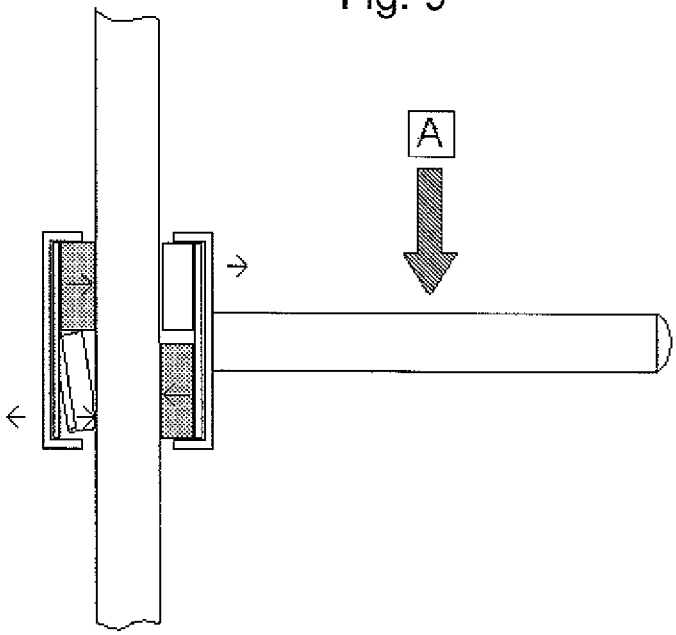
FIG. 9 shows the forces acting on the device when descending the stairs.

Finally, FIG. 9 shows the forces acting when descending stairs. When the user steps down they push down against the handle bar with a steady pressure across the bar 'A' (the same force 'A' would be applied if they fell against the handle bar). This action increases the force pressing the materials with a high coefficient of friction against the lateral sides of the handrail, providing support for the user until they are secure on the next step, when the handle bar can be moved down the handrail once again until the user has descended the full length of the staircase.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A stair assistance device for use with a handrail, the device comprising:

a sleeve having a handlebar extending therefrom, the sleeve engageable with and slideable relative to the handrail, and a removable pad assembly disposed within an interior of the sleeve, wherein when the stair assistance device is engaged with the handrail, said removable pad assembly is disposed between an internal surface of the sleeve and an outer surface of the handrail, wherein the removable pad assembly comprises a sprung steel backing plate from which an inwardly bent protrusion is formed comprising a spring strip in a portion of a first surface disposed at a first longitudinal end of the backing plate, said spring strip having the first surface bonded with a material having a first coefficient of friction for slidably engaging the outer surface of the handrail while a second surface disposed at a second longitudinal end of the sprung steel backing plate is bonded with a material having a second coefficient of friction, the second coefficient of friction being higher than the first coefficient of friction, wherein when the stair assistance device is engaged with the handrail, said spring strip provides a biasing force against the outer surface of the handrail so that the material with the second coefficient of friction is held in contact with the outer surface of the handrail to hinder or prevent movement of the sleeve relative to the handrail when the device is not in use, and wherein the handle bar is manually movably along the handrail when a user overcomes the biasing force.

2. A stair assistance device according to claim 1 wherein the removable pad assembly is releasably engageable with the sleeve.

3. A stair assistance device according to claim 1 wherein a free end of the spring strip is adjacent an edge of the backing plate.

4. A stair assistance device according to claim 1 wherein the removable pad assembly is releasably held within the sleeve.

5. A stair assistance device according to claim 4 wherein the removable pad assembly is releasably held by adhesion.

6. A stair assistance device according to claim 1 including a further pad assembly which is configured to engage with a different side of the handrail to the removable pad assembly.

7. A stair assistance device according to claim 6 wherein the further pad assembly is engageable with an opposite side of the handrail to the removable first said pad assembly.

8. A stair assistance device according to claim 1 which comprises a plurality of pad assemblies disposed within the sleeve that substantially encloses a handrail, the sleeve being slideably movable along the handrail, said pad assemblies comprising one or more linear springs that produce a force that applies a friction brake against the said handrail and providing a positive force, wherein the handle bar is manually movable up or down the handrail when a user overcomes the positive force.

9. A stair assistance device according to claim 1, wherein when the stair assistance device is engaged with the handrail, said removable pad assembly is disposed within a gap between an internal lateral surface of the sleeve and a lateral outer surface of the handrail.

* * * * *